US006708468B2

(12) United States Patent
Kondou et al.

(10) Patent No.: US 6,708,468 B2
(45) Date of Patent: Mar. 23, 2004

(54) APPARATUS FOR COUNTING AND PACKING SOLID FOODS

(75) Inventors: Hideyuki Kondou, Kanagawa (JP); Kenichi Nagashima, Kanagawa (JP); Makoto Wakabayashi, Gunma (JP); Hiroshi Takahashi, Gunma (JP)

(73) Assignee: Ajinomoto Co., Inc., Tokyo (JP)

( * ) Notice: Subject to any disclaimer, the term of this patent is extended or adjusted under 35 U.S.C. 154(b) by 0 days.

(21) Appl. No.: 10/004,894

(22) Filed: Dec. 7, 2001

(65) Prior Publication Data

US 2002/0104291 A1 Aug. 8, 2002

(30) Foreign Application Priority Data

Dec. 7, 2000 (JP) ..... 2000-373291

(51) Int. Cl.[7] ..... B65B 57/20; B65B 5/08

(52) U.S. Cl. ..... 53/501; 53/127; 53/247; 53/251

(58) Field of Search ..... 53/501, 127, 534, 53/531, 543, 247, 251

(56) References Cited

U.S. PATENT DOCUMENTS 4,385,482 A * 5/1983 Booth ..... 53/247
4,712,818 A * 12/1987 Borgman et al. ..... 294/64.1
4,790,116 A * 12/1988 Stridh ..... 53/251
5,224,325 A * 7/1993 Takahashi et al. ..... 53/443
5,706,634 A * 1/1998 Edwards et al. ..... 53/247
5,848,514 A * 12/1998 Edwards et al. ..... 53/53
5,942,188 A * 8/1999 Lepper et al. ..... 53/543

FOREIGN PATENT DOCUMENTS

DE 2601027 A * 7/1977 ..... B65B/35/38

* cited by examiner

*Primary Examiner*—Stephen F. Gerrity
(74) *Attorney, Agent, or Firm*—Oblon, Spivak, McClelland, Maier & Neustadt, P.C.

(57) ABSTRACT

An apparatus for counting and packing solid foods comprising a table device for holding the solid foods to be counted and packed, plural vacuum nozzles, a flexible vacuum pad, and adsorption confirmation sensors. The apparatus also includes an arm holding the vacuum nozzles. The vacuum nozzles are displaceable in horizontally in a right and left direction and in a vertically up and down directions. The vacuum nozzles are configured to adsorb and convey the solid foods from the table to a packing device. A vacuum breaking channel is used to cease adsorption by compressed air.

6 Claims, 4 Drawing Sheets

APPARATUS FOR COUNTING AND PACKING SOLID FOODS

FIELD OF THE INVENTION

The present invention concerns a method and apparatus for counting and packing solid foods having an undetermined shape, irregular; wet, adhesive, and soft surfaces; and that are easily broken.

BACKGROUND OF THE INVENTION

In the field of production engineering for processed food, instrumentation and unmanned operation of the process is still undeveloped. In particular, there is a great difficulty in handling small amounts of solid foods with an undetermined shape; irregular, wet, adhesive, and soft surfaces; and that are easily broken.

Problems in measuring, counting and packing quite frequently appear in new product development and with frozen foods. The current trend toward using more highly processed, simple and easy-to-cook products has led to increased use of small amounts of various seafoods and vegetables as ingredients.

However, because most of these ingredients are flexible and with uncertain shape, they are easily damaged by mechanical processing, and moreover, they often become viscous and stick to food processing machinery, making it difficult to convey or to precisely hold the ingredients by the machinery.

Therefore, there are many food products that must depend on manual operation which leads to high manufacturing costs. According to the prior art, it is possible to separate a predetermined number of objects, line up these objects in order, and pack desired objects from among an abundantly supply of solid objects, not limited to foods. Transportation through the packing process is usually by a device including vibrating feeders and/or a belt conveyor and a guide. The number passing are detected with a photo sensor or pictorial image sensor. This technology is employed widely in fields such as counting electron parts, industrial parts, tablets, or pellets.

This technology is also typically used in the foods industry for counting and packing confectioneries such as nuts or dried fruits, dried eggs, dried meat, or dried Kamabokoes that are attached to instant noodles such as "Kayaku". (Kamaboko is the fish paste that is pasted on to a Japanese cedar before steaming, and the cedar plate is separated before cooking.)

However, in the case where the solid foods have sizes and shapes that are not uniform, many problems frequently occur such that the conveyed solid foods are piled up without being separated one by one leading to intermittent blockages.

In addition; current conveyance technology includes controlling an attenuation of oscillation so as to regulate the conveying little by little when the counted number approaches a value predetermined to maintain a the precise number of packed items. However, this technology is unsuitable for packing only a few pieces leading to a fluctuation of packing time.

Furthermore, when the solid foods are wet and viscous, of the mechanical feeder and/or the solid foods sticks to each other, and stable transportation cannot regularly be achieved.

Various kinds of breakthrough are proposed in order to solve these problems. For example, JPA53-518 74 discloses an invention in which solid foods are separated one by one with an adsorption pad that is provided with a rotating drum. After being released by compressed air, the foods are counted in a chute section, and when the quantity reaches a predetermined value, a shutter opens.

JPA09-12143 discloses an invention in which solid foods are similarly separated one by one with an adsorption aperture provided with a rotating drum. The food items are peeled apart and aspirated by a jet air nozzle or an suction nozzle installed proximate to the drum, the food items are counted, and when the quantity reaches a predetermined value, the compressed air is stopped.

In addition, Japanese Laid-Open Utility Model No. 07-23739 discloses an invention in which solid foods are separated one by one with the adsorption aperture provided with a rotating drum. Here, the food items are peeled apart when they reach to an air shield board installed proximate to the drum, and then they are counted by a photo sensor.

These conventional teachings are effective for separately counting and packing, one-by-one, solid foods of uncertain shapes being conveyed at random. However, because these teachings require the solid foods to touch the adsorption aperture of the rotating drum in a predetermined home position, it is necessary to supplement these operations with other steps such as dropping the solid foods from an upper side of the rotating drum, or vibrating intensely the food items on a lower table. These conventional machines are unsuitable for solid foods prone to crumbling or generating powders or for solid foods, like frozen products, that easily break or crack. In addition, the solid foods may not be regularly adsorbed by each adsorption aperture provided for the drum, and because the procedure counts up from zero to the instruction value, the time required until the predetermined number of solid foods are finally packed will fluctuate. These fluctuating times are detrimental because, when a downstream process works with predetermined time interval, there are cases where the timing these two processes can not be synchronized.

On the other hand, there is a method for adsorbing, counting and conveying objects by an arm comprised one or plural of vacuum adsorption apertures. This method is a conventional technology that has been mainly used for gripping, transferring, and counting such parts with fixed form precisely positioned in the timing of being adsorbed as IC tips, wafers, or boards.

In this second conventional technology, the counting is executed by detecting an actuation frequency crossing the working space by the arm. Counting value is calculated on the premise that holding of the object by the vacuum adsorption aperture attached to the arm is complete. This technology is better at counting and packing or fixing easily breakable objects into a specific place within a designated time. However, this technology is limited to objects are dried, have fixed forms, and where the holding of the object by the vacuum adsorption aperture is precise. Therefore, in the case where the objects are solid foods with uncertain shape of which the vacuum absorption state is not stable and preparatory segregation positioning is difficult, this method is not applicable without any improvement because the possibility of an adsorption mistake is very high. Regarding the above-mentioned arm and nozzle procedure, some improvements using sensors have been proposed.

JPA60-54499 discloses a process of repeating the packing operation until the counting number reaches to the predetermined value while detecting whether a tip is safely adsorbed or not, where the tip number is determined directly by a pressure sensor in a negative pressure path.

JPA07-169819 discloses a process of repeating the vacuum adsorption operation until the counting number reaches the predetermined value of wafers in a case is appropriate, while detecting vacuum pressure to determine whether the state of adsorbing the wafer is safe or not.

However, even with these inventions are applied to the arm and nozzle technology, the time required until the predetermined numbers of the objects are finally packed fluctuates if an adsorption mistake happened. Meanwhile, a technology enabling synchronization with the next downstream process is disclosed in JPA5-229514.

JPA5-229514 discloses a process for a) detecting the weight of a conveyer bucket in a measuring station after a transfer of fruit pulp pieces, such as mandarin orange, a pine, and Megalobatrachus japonicas peach, to the conveyer bucket by a plurality of vacuum nozzles, b) identifying a conveyer bucket having a vacancy or a weight equal to a predetermined number of objects, and c) correcting the feed of the vacant conveyer bucket from a downstream replenishment line, thereby ensuring the predetermined number of objects are packed. This invention is effective in the case where it is not necessary to pre-position the object; and where the object is soft, and having moisture and adhesive surface. However, because the counted value is calculated by weight differentiation processing, precise counting and packing of predetermined number becomes difficult in cases where there are large weight variation in the objects and where several kinds of the foods are necessary to be filled in one container. In addition, the invention needs large line constitution, and only the transfer machine unit is unable to count and pack the objects.

Thus, as described above, when treating solid foods having an undetermined shape, irregular; wet, adhesive, and soft surfaces; and that are easily broken with conventional counting and packing devices, manual pre-positioning and sort transportation of the objects were necessary. Also, it is difficult to precisely count and pack several predetermined numbers of the object in one cycle within a time interval settled for the purpose of synchronization with the next process.

The present invention solves the above mentioned weak points in a counting and packing apparatus by combining a vacuum nozzle and an adsorption confirmation sensor together by providing a method and apparatus for counting and packing the solid foods having an undetermined shape, irregular; wet, adhesive, and soft surfaces; and that are easily broken, without requiring manual pre-positioning and sorting, thus enabling speedy and precise counting and packing of a predetermined numbers of the solid foods within a predetermined time interval.

SUMMARY OF THE INVENTION

In order to achieve the above described purpose of counting, transferring, and packing solid foods one by one via adsorbing with a vacuum nozzle, the present invention provides a method for counting and packing solid foods comprising arranging N+α vacuum nozzles, optionally counting and selecting plural numbers of the vacuum nozzles corresponding to the predetermined packing number N from among the N+α vacuum nozzles where adsorption holding was ensured by an output signal from an adsorption confirmation sensor, and, after having conveyed the solid foods to a predetermined packing location, the predetermined packing number N of the solid foods are precisely counted and packed within 1 cycle by breaking the vacuum of the selected vacuum nozzle.

Moreover, the present invention is directed to an apparatus for counting and packing solid foods, comprising a table device configured to hold the solid foods to be counted and packed; N+α vacuum nozzles, each of said N+α vacuum nozzles including a flexible vacuum pad and an adsorption confirmation sensor; an arm holding the N+α vacuum nozzles, said arm displaceable horizontally in a right and left direction and vertically in an up and down direction, said arm configured to adsorb and convey the solid foods from the table device to a packing device, a vacuum source connected to the N+α vacuum nozzles by a respective vacuum breaking channels, and a control instrument configured to execute a control sequence and to break a vacuum of a specified vacuum nozzle, wherein N is a predetermined number of solid foods to be packed, and N and α are integers greater than or equal to 1.

DESCRIPTION OF THE PREFERRED EMBODIMENTS

Figure 1:
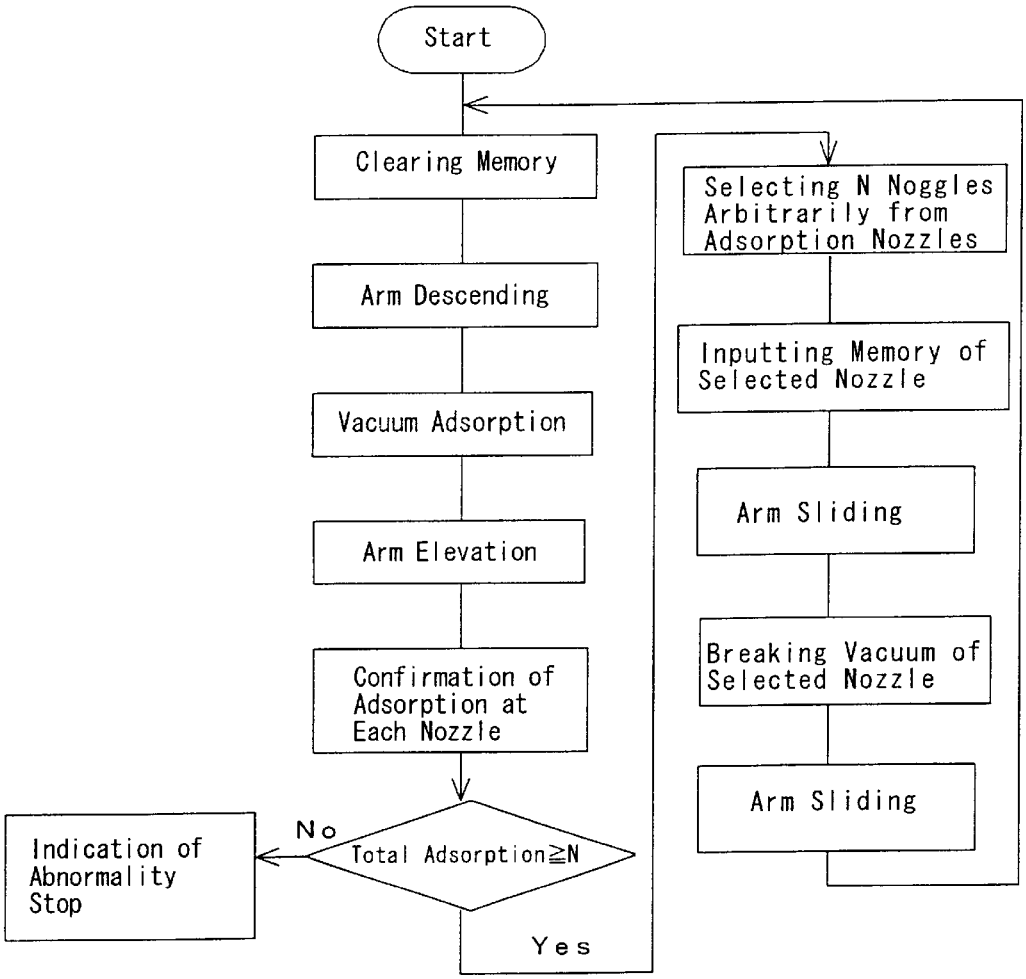
FIG. 1 shows flow chart of one embodiment of the invention.

In the above described structure of the apparatus, N+α, the number of the vacuum nozzle, are more than N, the predetermined packing number of solid foods.

In this invention, as more desirable condition, in order to make packing accuracy high it is preferable that the margin N+α might be at least a integer equal to or more than 1.5 times N, that is α=0.5N. In addition, by adding a rotation mechanism or a oscillation mechanism to the table means for placing the solid foods which should be counted and packed, and by making upper surface of the solid foods that are piled up smoother, it is desirable to place the solid foods at the leading end of the vacuum nozzles moving down at the settled position.

Moreover, regarding the object that tends to stick to each other in a thaw state depending on their shape, e.g., a separated frozen sheath of green pieces, it is preferable to provide a freezing mechanism such as a brine cooling jacket or a cold air blast to the table means for the purpose of maintaining the frozen state for a long time. The freezing mechanism prevents thawing and to reduces adsorption loss.

Moreover, as for the vacuum pads attached to the leading end of the vacuum nozzles, their calibers, shapes may be changeable to correspond to the size and surface characteristic of the objects because it becomes impossible to precisely count the objects in the case where plural of the solid foods were adsorbed to one adsorption nozzle.

Furthermore, the adsorption confirmation sensor may be arranged to detect the adsorption state of each nozzle individually via, for example, a pressure sensor, a pictorial image sensor, an optical sensor, a photo sensor, a limit switch, etc.

In this invention, at first, an arm having N+α vacuum nozzles falls down on the solid foods randomly scattered on the table while the nozzles are vacuum suctioned, and, thus, the nozzles adsorb the ingredients.

After the arm lifted up, confirming that each nozzle adsorbed the object by the pressure sensor, the nozzle is recognized as adsorbing the solid foods and the system takes this state in as data. Then, optionally, the system counts and selects the N nozzles, and, after the arm moved to the appointed position for packing, only the N selected nozzles are shifted to the compressed air channel by a solenoid valve and their vacuum is broken.

By this serial action, N pieces are counted and packed in a container, belt conveyor, etc. within 1 cycle. This process and repetitions of the process may be executed intermittently and/or automatically. In addition, the invention may be interfaced to a personal computer or a control system using a sequencer for preparing input actuation, termination, actuation order, actuation direction, and actuation interval of each part.

Further, there is not any special limitation in the material of each parts employing in the apparatus of this invention, and every material employed generally in the food production machines can be adopted. Moreover, there is not any restriction in particular to the kind of the solid foods as the objects for counting and packing, and broadly all kinds of solid foods can be counted and packed by the apparatus of this invention.

To be concrete, every food ingredients such as a boiled lobster, boiled cuttlefish, boiled meats, precut salad, fruit pulp part; and a separated frozen sheath of green pieces can be counted and packed by the apparatus of this invention. Moreover, there is not any particular restriction in the range of counting, and adjusting or settling the related parts number and control of such as the vacuum nozzles or the sensors appropriately might expect wide range of counting.

A change of the predetermined packing number can be easily and rapidly accommodated by mere change of counting value on the condition that some margins in the number of the nozzles were prepared beforehand. Moreover, because there is no need for moving solid foods themselves widely for the purpose of their adsorption, and no needs for conveying themselves for recycling, the counting and packing of the objects that are fragile and easily broken, that generate powders, or objects that easily break or crack, become possible without damaging them.

Figure 2:
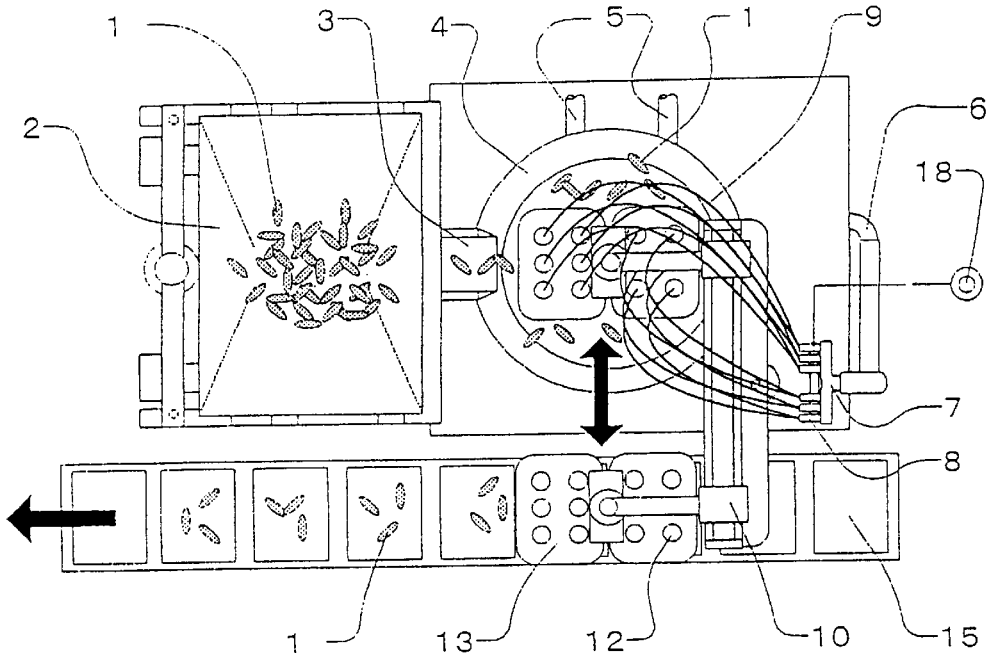
FIG. 2 is explanatory drawing from top of the whole device that shows one embodiment of the invention.
Figure 3:
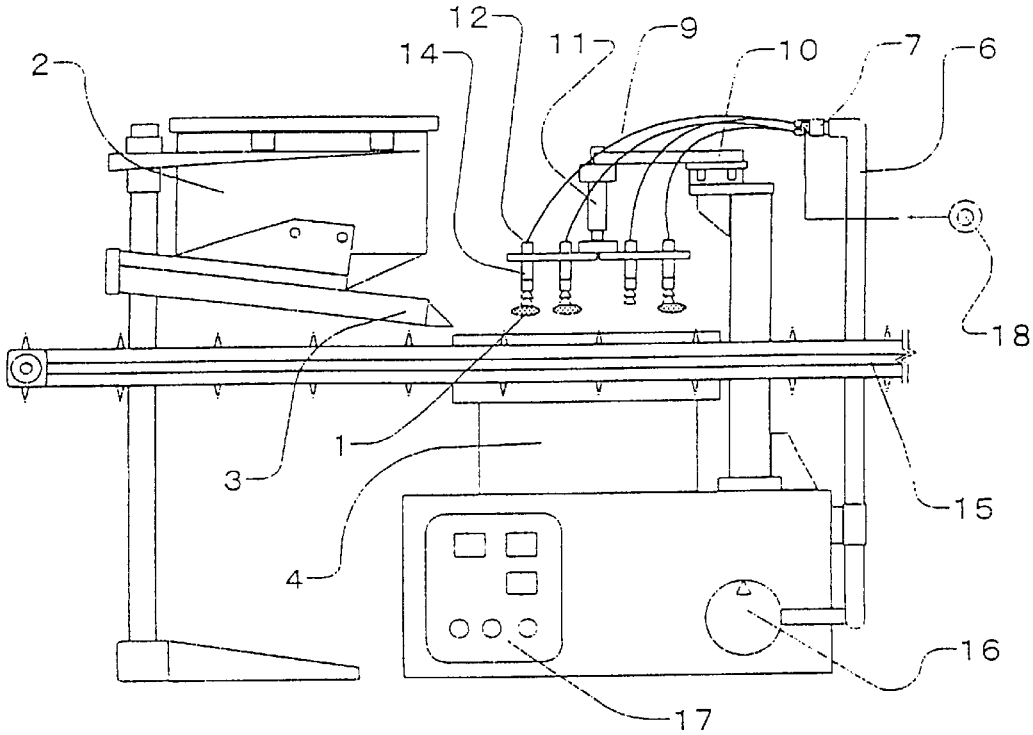
FIG. 3 is explanatory drawing from one side of the whole device that shows one embodiment of the invention.
Figure 4:
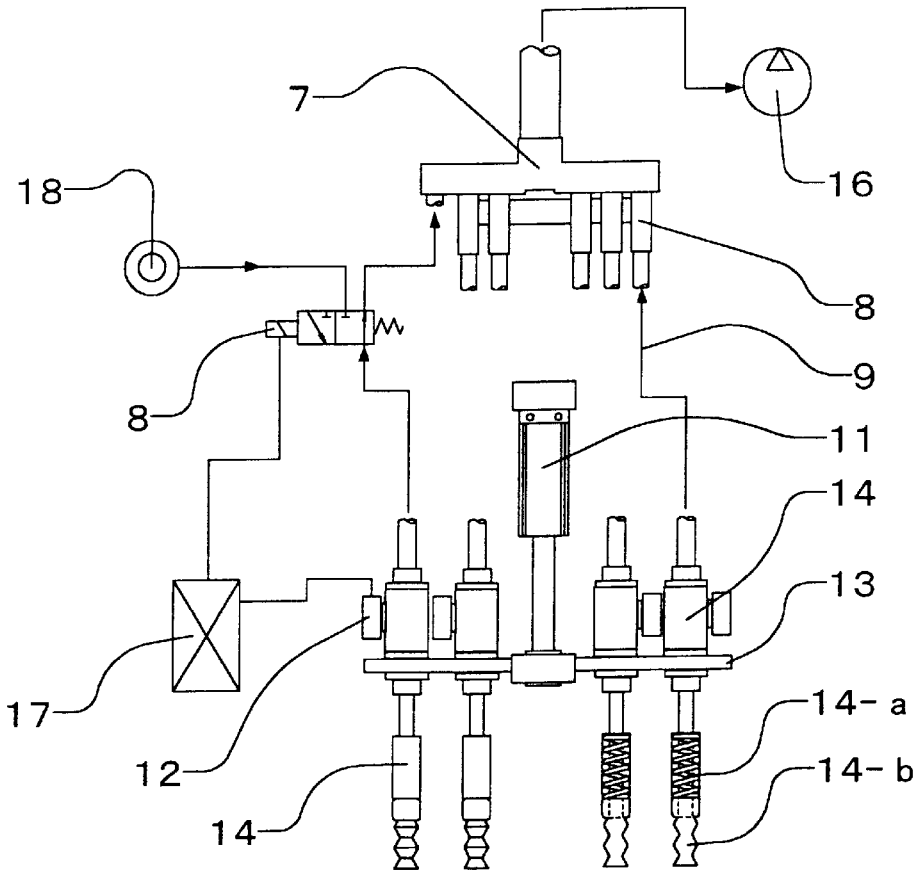
FIG. 4 is explanatory drawing of conception of the vacuum nozzle that shows one embodiment of the invention.

Preferred embodiments of the present invention will be described in detail with reference to the attached drawings. FIG. 1 shows flow chart of one embodiment of the invention. FIGS. 2–4 show respectively explanatory drawings of the top, one side, and the vacuum nozzle part of the whole apparatus. By way of example, the Figures are directed to an apparatus for automatically counting and packing each three separated frozen sheathes of green pieces into the belt conveyor intermittently operating in synchronization with a downstream pouch packing machine.

Separated frozen sheath of green pieces 1 as solid foods is supplied from hopper 2 including electromagnetic vibration machines 3 at any time to table means 4. Table means 4, including a rotation mechanism or a vibration mechanism, ensures that frozen sheath of green piece 1 being under the leading ends of six vacuum nozzles 14 falling down in home position.

In addition, when frozen sheathes of green pieces 1 are defrosted, they can stick each other by the influence of their moisture, and the segregation of the green pieces becomes difficult. Therefore, for the purpose of maintaining the frozen state for a long time, the mechanism for the maintenance of the stable ingredients supplying state providing a freezing mechanism such as brine cooling jacket 5 or a cold air blast to table means 4. Six vacuum nozzles 14 are fixed to adsorption head part 13 at an equal distance, and actuated in an up and down direction driven by air cylinder 11. Pressure sensor 12 for confirming the adsorption, flexible negative pressure channel 9, and solenoid valve 3 for channel switching in the time of vacuum breaking are installed above each vacuum nozzle, and they are connected to vacuum pump 16 through header 7.

Spring 14-*a* is built in to vacuum nozzle 14, and bellows-shaped adsorption pad 14-*b* is attached to the leading end of spring 14-*a*, ensuring that adsorption pad 14-*b* fits and securely adsorbs the surface of solid foods of uncertain shape. Moreover, the caliber of the vacuum nozzle is settled to be 0.7 mm in order to prevent complex (i.e., multi-piece) adsorption.

Frozen sheath of green piece 1 on table 4 is vacuum adsorbed to adsorption nozzle 14 after the fall of adsorption head 13 driven by air cylinder 10, then pressure sensor 12 provided in each nozzle ensures adsorption to each nozzle by the time adsorption head 13 is moved back up. Determination of a stable adsorption is accomplished when the internal-pressure of the vacuum nozzle reaches a constant degree of vacuum, and this information is taken in to a memory device.

Further, when vacuum adsorption can not be considered to be sure, it is probable that a total adsorption number is less than the predetermined packing number N. Therefore, the condition that the number of the vacuum nozzle might be at least equal to or more than 1.5 times N can reduce the probability of undercounting. Then, optionally counting and selecting the necessary nozzles depending on the predetermined packing number N from among the nozzles that the stable adsorption were confirmed, and this information is also delivered to a memory device.

In this example, the predetermined packing number N is 3, and the 1st, 2nd, 4th and 6th nozzle stably adsorbs the objects, the selected nozzles are 1st, 2nd, and 4th nozzle. After the arm is driven by air cylinder 10, the dissociation of frozen sheath of green piece 1 from vacuum nozzle 14 is executed by breaking vacuum by a short negative pressure channel 9 to compressed air channel 18 driven by solenoid valve 8, affecting only the selected 1st, 2nd, and 4th nozzle. Thus, the objects are packed onto the belt conveyor which is operating intermittently within constant interval driven by a stepping motor.

After packing, all the negative pressure channels shift back to compressed air channel 18 synchronous with the arm having returned to the initial position, the rest of the adsorbed objects are separated from the nozzles and the system comes back to its initial state. Defining the above-described sequence as 1 cycle, the operation of counting and packing is repeated.

Under the condition that the predetermined packing number N of frozen sheath of green piece 1 was 3, and that the number of the vacuum nozzle N+$\alpha$ were 3,4,5,6 ($\alpha$=0,1,2,3) respectively, abnormal stop rate were shown in Table 1. (The number of total adsorption <N)

TABLE 1

| | | | | |
|---|---|---|---|---|
| Predetermined Packing Number N [pieces] | 3 | 3 | 3 | 3 |
| Number of the nozzles N + $\alpha$ [pieces] | 3 | 4 | 5 | 6 |
| Abnormal stop rate [%] | 35 | 15 | 1 | 0.5 |

As shown in Table 1, when counting and packing frozen sheath of green piece 1 was executed using the counting and packing apparatus for solid foods of this invention, the counting accuracy of 99% or more was ensured under the condition that the number of the vacuum nozzles was 5 or more for predetermined packing number 3.

As described above, according to the present invention, regarding the technology of counting and packing of solid foods having an undetermined shape, irregular; wet, adhesive, and soft surfaces; and that are easily broken, it becomes possible to speedily and precisely count and pack predetermined numbers of the solid foods within a predetermined time interval without requiring manual prepositioning and sort transportation of the objects.

While there has been described what is at present considered to be the preferred embodiment of the invention, it will be understood that various modifications may be made therein, and the present application is intended to cover all such modifications that fall within the true spirit and scope of the invention.

What is claimed is:

1. An apparatus for counting and packing solid foods, comprising:

a table device configured to hold the solid foods to be counted and packed;

N+α vacuum nozzles each of said N+α vacuum nozzles including a flexible vacuum pad and an adsorption confirmation sensor;

an arm holding the N+α vacuum nozzles, said arm displaceable horizontally in a right and left direction and vertically in an up and down direction, said arm configured to adsorb and convey the solid foods from the table device to a packing device;

a vacuum source connected to the N+α vacuum nozzles by respective vacuum breaking channels; and a control instrument configured to execute a control sequence and to break a vacuum of a specified vacuum nozzle, wherein N is a predetermined number of solid foods to be packed, and N and α are integers greater than or equal to 1.

2. An apparatus according to claim 1 wherein said control instrument comprises:

a control sequence for optionally counting and selecting N vacuum nozzles among the N+α vacuum nozzles by individually determining, by a output signal from the corresponding adsorption confirmation sensor, the N vacuum nozzles having adsorbed a piece of said solid food.

3. An apparatus according to claim 1 wherein α is greater than or equal to 0.5 times N.

4. An apparatus according to claim 1 wherein said table device comprises:

at least one of a rotation mechanism and a vibration mechanism.

5. An apparatus according to claim 1 wherein said table device further comprises:

a freezing mechanism.

6. An apparatus according to claim 1 wherein said adsorption confirmation sensor comprises:

a pressure sensor.

* * * * *